United States Patent [19]

Green

[11] 4,037,757

[45] July 26, 1977

[54] PREPARATION OF BEVERAGES

[75] Inventor: David William Green, Eastbourne, England

[73] Assignee: British Syphon Industries Limited, Sheffield, England

[21] Appl. No.: 671,287

[22] Filed: Mar. 29, 1976

[51] Int. Cl.[2] ..... B67D 5/56

[52] U.S. Cl. ..... 222/129.2; 222/76

[58] Field of Search ..... 222/57, 129.1, 129.2, 222/76, 145

[56] References Cited

U.S. PATENT DOCUMENTS

| | | | |
|---|---|---|---|
| 3,225,962 | 12/1965 | Leobeck | 222/57 X |
| 3,317,084 | 5/1967 | Welty | 222/57 |
| 3,369,755 | 2/1968 | Roden et al. | 222/129.2 X |
| 3,520,448 | 7/1970 | Russell | 222/57 |

FOREIGN PATENT DOCUMENTS

| | | | |
|---|---|---|---|
| 654,145 | 12/1937 | Germany | 222/63 |

*Primary Examiner*—Robert B. Reeves
*Assistant Examiner*—Hadd Lane

[57] ABSTRACT

An apparatus for preparing a beverage by mixing together a diluent and a concentrate of the required beverage in the required proportions, the diluent being supplied from a diluent container under the pressure of a top pressure of gas and the concentrate being supplied by means of a pump. The pump may be of the kind having a reciprocable member disposed in a pumping chamber and carrying a non-return valve, the reciprocable member being displaced, under the influence of a coil carrying a one-half wave rectified alternating current, against the force of a spring. The pump is caused to be driven while diluent is flowing from the diluent container.

4 Claims, 4 Drawing Figures

PREPARATION OF BEVERAGES

The invention relates to the preparation of beverages and has for its object to provide an improvement therein.

According to one aspect of the invention, there is provided a method of preparing a beverage, the method including the steps of pressurising a quantity of a diluent by a top pressure of gas and connecting said quantity of diluent to a dispense apparatus, connecting a container containing a concentrate of the beverage required to a pump and connecting said pump to said dispense apparatus, and operating the dispense apparatus in such a way that a measure of the diluent and a measure of concentrate are delivered to a mixing chamber to be mixed together to produce the beverage required in a required condition. The diluent may be water and the gas used to apply the top pressure thereto may be carbon dioxide.

According to another aspect of the invention, there is provided apparatus for preparing a beverage, the apparatus including a container for a quantity of a diluent, means for pressurising said container by a top pressure of gas, means connecting said container to a dispense apparatus, a container for a concentrate of the beverage, and a pump for feeding a measured quantity of the concentrate to the dispense apparatus. A switch which is provided for automatic actuation when the diluent is caused to flow to the dispense apparatus, whereby the pump for feeding the concentrate to the dispense apparatus runs whenever the diluent is flowing, is preferably a flow switch disposed in association with the means connecting the container for the diluent to the dispense apparatus, said flow switch having an element which is displaced to close the switch by a flow of the diluent and which returns to an initial position to open said switch when the flow of diluent ceases. The flow switch may include a so-called reed switch and a plunger disposed within the flow of the diluent and provided with or constituting a permanent magnet so that its movement under the influence of diluent flow causes the opening and closing of said reed switch. The plunger may be caused to move by the flow of diluent through it or around it or impinging against it. The apparatus will preferably include respective non-return valves on opposite sides of the pump, that is to say in respective supply and delivery conduits. The pump will preferably be of the kind having a reciprocable member disposed in a pumping chamber and carrying a non-return valve, the reciprocable member conveniently being displaced under the influence of a coil carrying a one-half wave rectified alternating current against the force of a spring.

Figure 1:
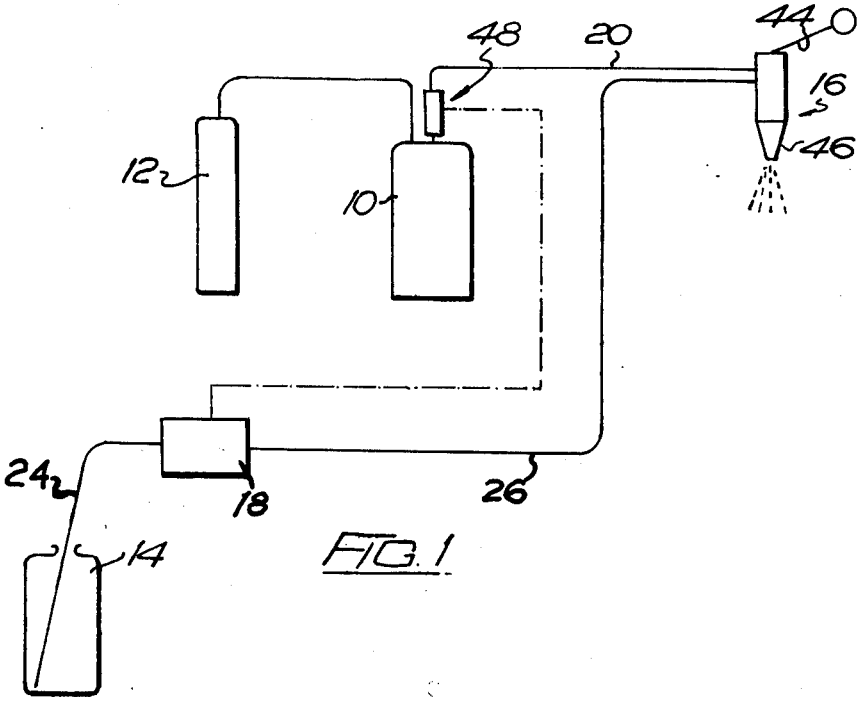
Figure 2:
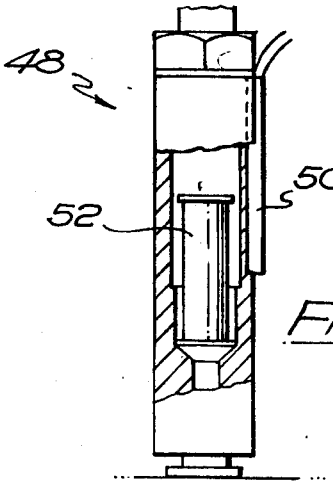
Figure 3:
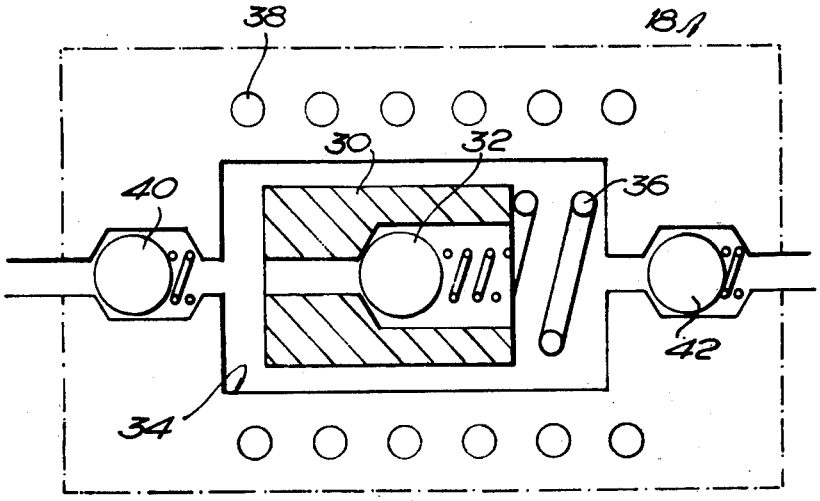
Figure 4:
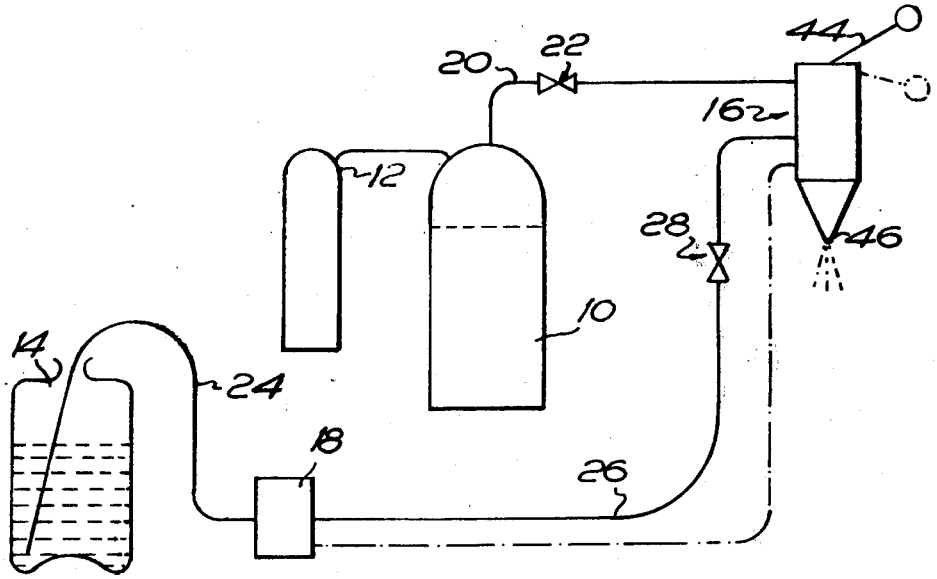

In order that the invention may be fully understood and readily carried into effect, the same may now be described, by way of example only, with reference to the accompanying drawings, of which:

FIG. 1 is a diagrammatic illustration of apparatus embodying the invention for preparing a beverage, FIG. 2 is a diagrammatic illustration of a flow switch forming a part of the apparatus, FIG. 3 is a diagrammatic illustration of a pump forming a part of the apparatus, and FIG. 4 is a diagrammatic illustration, similar to that of FIG. 1, of a modified form of the apparatus.

Referring now to FIG. 1 of the drawings, the apparatus there illustrated for preparing a beverage includes a container 10 for a diluent; means for pressurising said container by a top pressure of gas, said means being constituted by a pressure cylinder 12 of carbon dioxide gas; a container 14 for a concentrate of the beverage; dispense apparatus generally indicated 16; and a pump 18 for feeding a measured quantity of the concentrate to the dispense apparatus.

The container 10 for the diluent is connected to the dispense apparatus by means of a conduit 20. Respective supply and delivery conduits 24 and 26 connect the pump to the container 14 and to the dispense apparatus.

The dispense apparatus 16 includes a tap 44 and dispense nozzle 46. The arrangement is such that when the tap is opened a flow switch generally indicated 48 is caused to close so that electric current is supplied to the pump 18 as indicated by the chain-dotted line in FIG. 1. When the tap is closed the electric switch is automatically opened and the pump stops.

Referring to FIG. 2, the flow switch 48 includes a so-called reed switch 50 and a plunger 52 in the form of a bobbin and constituting a permanent magnet disposed within the flow of diluent from the container 10 so that its movement under the influence of diluent flow around it causes the closing of said reed switch. Thus it will be seen that the flow switch is provided for automatic actuation to start the pump when the diluent is caused to flow to the dispense apparatus. The plunger 52 returns to an initial position of rest to open the reed switch and stop the pump when the flow of diluent ceases.

Referring to FIG. 3, the pump 18 has a reciprocable member 30 carrying a non-return valve 32 and disposed in a pumping chamber 34. A coil spring 36 acts against said reciprocable member in one direction and a coil 38 carrying a one-half wave rectified alternating current surrounds the pumping chamber so that when energised it displaces the reciprocable member against the force of the spring. Respective non-return valves 40 and 42 are provided on opposide sides of the pump, that is to say in the supply and delivery conduits. The arrangement is such that when the pump is energised the vibrations induced in the reciprocable member draw the concentrate from the container 14 and force it through the delivery conduit 26. The design of the pump is such that the reciprocable member does not require sealing rings or glands.

The dispense apparatus is such that the concentrate and the diluent are mixed together before being dispensed through the nozzle 46 (into a glass or the like held beneath it). Thus it will be seen that the required proportions of diluent to concentrate are fixed according to the flow characteristics through the conduits 20 and 26, the amount of top pressure applied to the diluent, and the delivery rate of the pump.

It will be seen that being constantly subject to a top pressure of carbon dioxide gas the diluent is carbonated to at least some extent (and indeed the container 10 may be a carbonator designed to carbonate the diluent, which may for example be water). However, the concentrate of the beverage in its container 14 is acted on only by atmospheric pressure (although it could be acted upon by a relatively low pressure of gas intended only to exclude air from contact with the concentrate and thereby prevent oxidation and/or deterioration of the concentrate which might otherwise occur), and consequently remains undiluted until mixed with the carbonated diluent in the dispense apparatus to produce a carbonated beverage. This is a distinct advantage over previously known arrangements in which the concentrate has been acted on by a top pressure of carbon dioxide gas because in such previously known arrangements it has been found that the concentrate itself has become to some extent carbonated and this has upset the proper mixing of the concentrate with the diluent. Other advantages include the saving of cost of carbon dioxide gas which previously would fill the concentrate container when this became empty, the need to vent this off and the avoidance of hazards associated with a vessel containing gas at high pressure. Further the concentrate vessel may more safely and conveniently be made transparent so that its contents may be checked. Also such a vessel may be cheap and disposable since as previously stated it does not need to be capable to withstanding a high internal pressure.

Referring now to FIG. 4, in a modified form of the apparatus illustrated in FIG. 1 the flow switch 48 has been omitted and the arrangement is such than when the tap 16 is opened a switch (not shown) is closed to supply electric current to the pump 18 as indicated by the chain-dotted line. When the tap is closed the electric switch is automatically opened. In addition it will be seen that in the apparatus illustrated in FIG. 4 flow regulators 22 and 28 have been added in conduits 20 and 26 so that the rate of discharge of the beverage from the nozzle will be determined by the setting of the flow regulators and so that the ratio of diluent to concentrate can also be adjusted according to the setting of the flow regulators.

Various other modifications may be made without departing from the scope of the invention. For example, the plunger forming part of the flow switch in the apparatus illustrated in FIG. 1 need not necessarily be in the form of a bobbin and it could be provided with a permanent magnet instead of itself constituting a permanent magnet. Furthermore, the arrangement could be such that instead of, or in addition to, the flow of diluent being around the plunger it coud take place through the plunger (the plunger being in the form of a ring) or it could be arranged for the flow of diluent merely to impinge against the plunger. The plunger could in fact be replaced by a flapper element free to swing in response to the flow of diluent.

What I claim and desire to secure by Letter Patent is:

1. Apparatus for preparing a beverage, comprising a container for a quantity of a diluent; means for pressurizing said container by a top pressure of gas; dispense apparatus; means for connecting said container to said dispense apparatus; a container for a concentrate of the beverage; a pump for feeding a measured quantity of said concentrate to the dispense apparatus; said pump having a reciprocable member disposed in a pumping chamber and carrying a non-return valve, a spring biasing said reciprocable member, said reciprocable member being displaced, under the influence of a coil carrying a one-half wave rectified alternating current, against the force of said spring, and non-return valves disposed on opposite sides of the pump for the respective supply of said concentrate from said container therefor and delivery of said concentrate to said dispense apparatus and means for opening said dispense apparatus to flow of diluent from the diluent container and for simultaneously driving the pump whereby the diluent and a measure of said concentrate are mixed together,

2. The apparatus according to claim 1, including a switch arranged for automatic actuation when the diluent is caused to flow to the dispense apparatus, the actuation of said switch causing the pump to be driven.

3. The apparatus according to claim 2, wherein the automatic switch is a flow switch disposed in association with the means connecting the container for the diluent to the dispense apparatus, said flow switch having an element which is displaced to close the switch by a flow of the diluent and which returns to an initial position to open said switch when the flow of diluent ceases.

4. The apparatus according to claim 1, wherein the dispense apparatus includes a tap and a switch arranged for automatic actuation when said tap is opened to cause a flow of diluent to said dispense apparatus and the concentrate pump to be driven, the flow of diluent under the top pressure of gas in its container and the flow of concentrate delivered by the pump being such as to cause the diluent and concentrate to be mixed together in the required proportions for said beverage.

* * * * *